US006699122B1

(12) United States Patent
Osawa

(10) Patent No.: US 6,699,122 B1
(45) **Date of Patent: *Mar. 2, 2004**

(54) GAMING MACHINE

(75) Inventor: Akira Osawa, Tokyo (JP)

(73) Assignee: Aruze Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/268,960

(22) Filed: Mar. 15, 1999

(30) Foreign Application Priority Data

Mar. 16, 1998 (JP) ..... 10-064911

(51) Int. Cl.[7] ..... A63F 1/00
(52) U.S. Cl. ..... 463/20; 463/16; 463/17
(58) Field of Search ..... 463/16–22; 273/143 R

(56) References Cited

U.S. PATENT DOCUMENTS

| | | | | | |
|---|---|---|---|---|---|
| 4,712,799 | A | * | 12/1987 | Fraley | 273/138 A |
| 5,393,057 | A | * | 2/1995 | Marnell, II | 273/85 CP |
| 5,647,798 | A | | 7/1997 | Falciglia et al. | 463/19 |
| 5,772,509 | A | * | 6/1998 | Weiss | 463/16 |
| 5,788,573 | A | * | 8/1998 | Baerlocher et al. | 273/138.2 |
| 5,883,538 | A | * | 3/1999 | Keeth et al. | 326/81 |
| 5,980,384 | A | * | 11/1999 | Barrie | 463/16 |
| 5,984,781 | A | * | 11/1999 | Sunaga | 463/20 |
| 6,033,307 | A | * | 3/2000 | Vancura | 463/20 |
| 6,203,429 | B1 | * | 3/2001 | Demar et al. | 273/143 R |
| 6,234,897 | B1 | * | 5/2001 | Frohm et al. | 273/143 R |

FOREIGN PATENT DOCUMENTS

| | | | | |
|---|---|---|---|---|
| EP | 0 449 433 A | | 10/1991 | G07F/17/34 |
| GB | 2222712 A | * | 3/1990 | |
| GB | 2242300 A | * | 9/1991 | |
| JP | 61-113488 | | 5/1986 | |

* cited by examiner

*Primary Examiner*—Jessica Harrison
*Assistant Examiner*—Carmen D. White
(74) *Attorney, Agent, or Firm*—Rohm & Monsanto, P.L.C.

(57) ABSTRACT

A gaming machine has variable display devices for variably displaying a plurality of symbols necessary for a game, a controller for controlling variable action of the variable display devices, and a display device for displaying optional images. The images displayed by the display device are necessary for a secondary game different from a principal game executed by the variable display devices and are determined in relation to the symbols displayed when the variable action of variable display devices is stopped.

4 Claims, 18 Drawing Sheets

(A)ALL CLEAR SCREEN (B)"HIGH "CONDITION SCREEN (C)"MEDIUM "CONDITION SCREEN (D)"LOW "CONDITION SCREEN

GAMING MACHINE

BACKGROUND OF THE INVENTION

1. Field of the Invention

This invention relates to gaming machines, such as slot machines, "Pachi-Slo" machines, video poker machines, or similar systems that have a variable display for displaying a plurality of variable symbols that are necessary for playing a game, and a controller for controlling variation in the action of the variable display, such as a microcomputer.

2. Description of the Related Art

A gaming machine such as a slot machine or "Pachi-Slo" machine usually has a variable display that is mechanically consisting of a plurality rotating reels, each provided with a plurality of symbols on peripheral surfaces thereof, and arranged in a display window located at the front of the machine. Alternatively, a variable electrical display is configured to illustrate reels with symbols on a screen. In response to a start operation by a player, the controller drives the variable display device to initiate rotation of each reel and to stop the rotation of each reel automatically in a determined order after either expiration of a predetermined period of time or in response to a stop operation by a player. When the rotation of all reels stops, with a specific combination of symbols (winning pattern) being shown in the display window, the player is given an award in the form of a payout of gaming media, such as coins.

In a slot machine, a win, which is represented by a winning combination of symbols being positioned to line up along an effective line on the top of the display portion when rotation of the reels stops, occurs only when a win has been internally determined by the gaming machine. In practice, this occurs when a sampling operation of a random number by a microcomputer has determined a win.

It is, however, a problem with known slot machines that an expert player will eventually lose the desire to play the game. Since winning or losing is determined by an internal procedure of the gaming machine, the game becomes monotonous and the player loses interest.

On known approach to maintaining player interest in playing the gaming machine is to provide a further game on the same gaming machine, the further game being different from the primary game and displayed on another display device. One example of this arrangement is described in Japanese Patent Application Kokai (Laid-Open) No. 61-113488 which discloses a slot bingo game machine wherein numeral displays of the slot game are used as selection numbers of a "bingo game." In this manner, the intensity added by the bingo game played enhances the slot game.

In this known arrangement, however, the slot game is used as a mere additional function to the bingo game in the gaming machine disclosed in the above reference, and therefore, the problem of eventual monotony with the gaming machine is not overcome. In addition, the display of the bingo game is fixed and less variable than that of the slot game. Moreover, variation in the display of the bingo game occurs only when the predetermined symbols become aligned on a predetermined line of the variable portion of the principal display. Therefore, the maintenance of player interest in the gaming machine has not been improved by the known arrangement.

SUMMARY OF THE INVENTION

An object of the present invention is to provide a gaming machine that can extend a chance at an award to a player by providing a secondary game that is different from the principal game. The secondary game is started in response to the information displayed by the variable display device when the variable display is stopped such that the principal game and the secondary game relate to each. Thus, the player's interest level in the game will be increased.

According to the present invention, a gaming machine is provided with a variable display device for variably displaying a plurality of symbols necessary for a principal game, a controller for controlling variable action of the variable display, and a secondary display for being possible to display optional images. The images displayed on the secondary display are necessary for the secondary game different from the principal game performed by the variable display, wherein the images displayed by the secondary display are determined in relation to the displays when the variation in the variable display is stopped.

For example, preferably, the secondary game becomes "hit" (e.g., completion of a bingo tile) when a plurality of predetermined symbols are aligned in a particular direction or a plurality of predetermined symbols are displayed in all of the predetermined positions on a display screen of the secondary display, whereupon a predetermined award is given to the player.

The secondary display may include electric displays such as liquid crystal, CRT, and LED, display arrangements, as well as mechanical displays, such as a rotating reel structure of the type that is used in conventional slot machines. Therefore, the images displayed by the secondary display may be distinguished from each other by using various kinds of characters and figures, animations, flashing lights, and the like, as well as symbols and patterns displayed on the surfaces of the rotatable reels.

In one embodiment of the present invention, the secondary game is started in the secondary display when specific symbols are displayed in predetermined positions when the variation in the variable display device is stopped.

The variable display includes, in certain embodiments, a plurality of movable display portions that movably display a plurality of symbols in the vertical direction, the movable display portions being disposed parallel to each other in side-by-side arrangement. The secondary display has a display screen that displays a plurality of blocks corresponding to symbol display positions when each of a plurality of movable display portions is stopped. Also, the variable display device may include a plurality of display portions disposed parallel laterally side-by-side that display a plurality of the symbols. The secondary display has a display screen that displays a plurality of blocks that are arranged parallel to each other and side-by-side so as to form a group. The displayed blocks are arranged to correspond to each position of a plurality of the display portions. A plurality of such groups is vertically arranged on the display screen.

The secondary display, in one embodiment of the invention, displays symbol images that are identical to predetermined symbols in the blocks that correspond to the display positions of the predetermined symbols on the display screen every time the predetermined symbols appear at the time the variable display is stopped and after starting the secondary game. The secondary display does not display other symbol images when the symbol images have already been displayed in the block.

In certain embodiments of the present invention, the predetermined symbols that appear on the secondary display are selected from the plurality of symbols of the principal display.

The gaming machine can reward the player when the display screen satisfies a predetermined end condition. The various awards that can be provided to a player are different from each other depending on kinds of the predetermined symbols. The predetermined end condition corresponds to the condition in which the predetermined blocks of the display screen display the predetermined symbol images.

In some embodiments of the present invention, the controller executes a resetting procedure to return the display screen to an initial screen after the display screen satisfies the predetermined end condition. The resetting procedure may include clearing all of the symbol images displayed in the blocks on the display screen or displaying the symbol images in optional blocks after clearing all of the symbol images.

According to the present invention, it is easy to adjust the probability of winning and the allotment of the profit throughout the game by adjusting a frequency of appearance of the particular symbols necessary for the secondary games that are displayed in the variable display when the principal game is in progress.

BRIEF DESCRIPTION OF THE DRAWING

Comprehension of the invention is facilitated by reading the following detailed description, in conjunction with the annexed drawing, in which.

DETAILED DESCRIPTION

Figure 1:
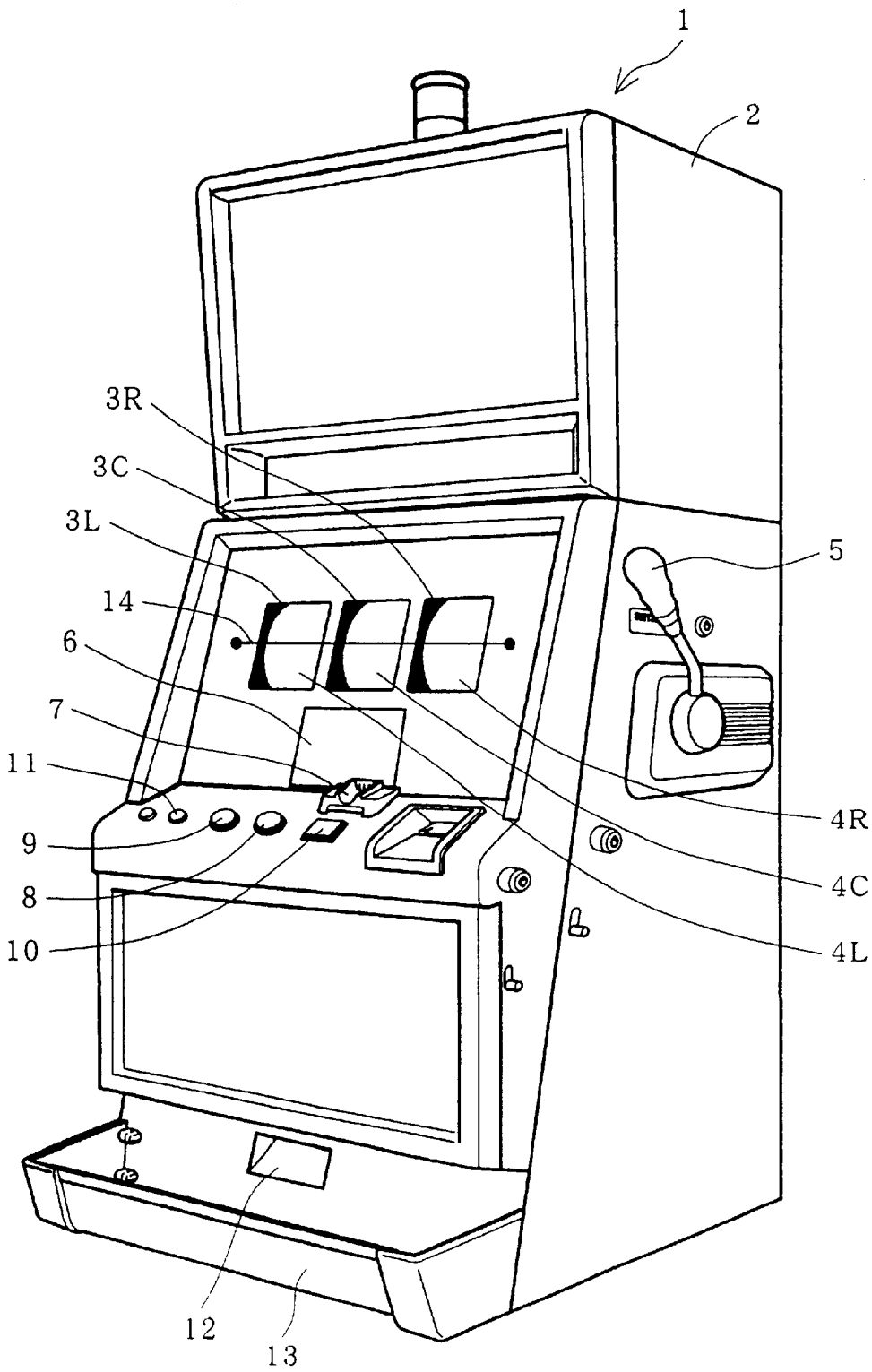
FIG. 1 is a perspective representation of a specific illustrative embodiment of the invention in the form of a slot machine.

FIG. 1 is a perspective representation of a specific illustrative embodiment of the invention in the form of a slot machine 1. As shown, slot machine 1 is a gaming machine played using a coin, medal or token, and the like as game media. Hereinafter, the game medium will be referred to as a "coin."

Figure 2:
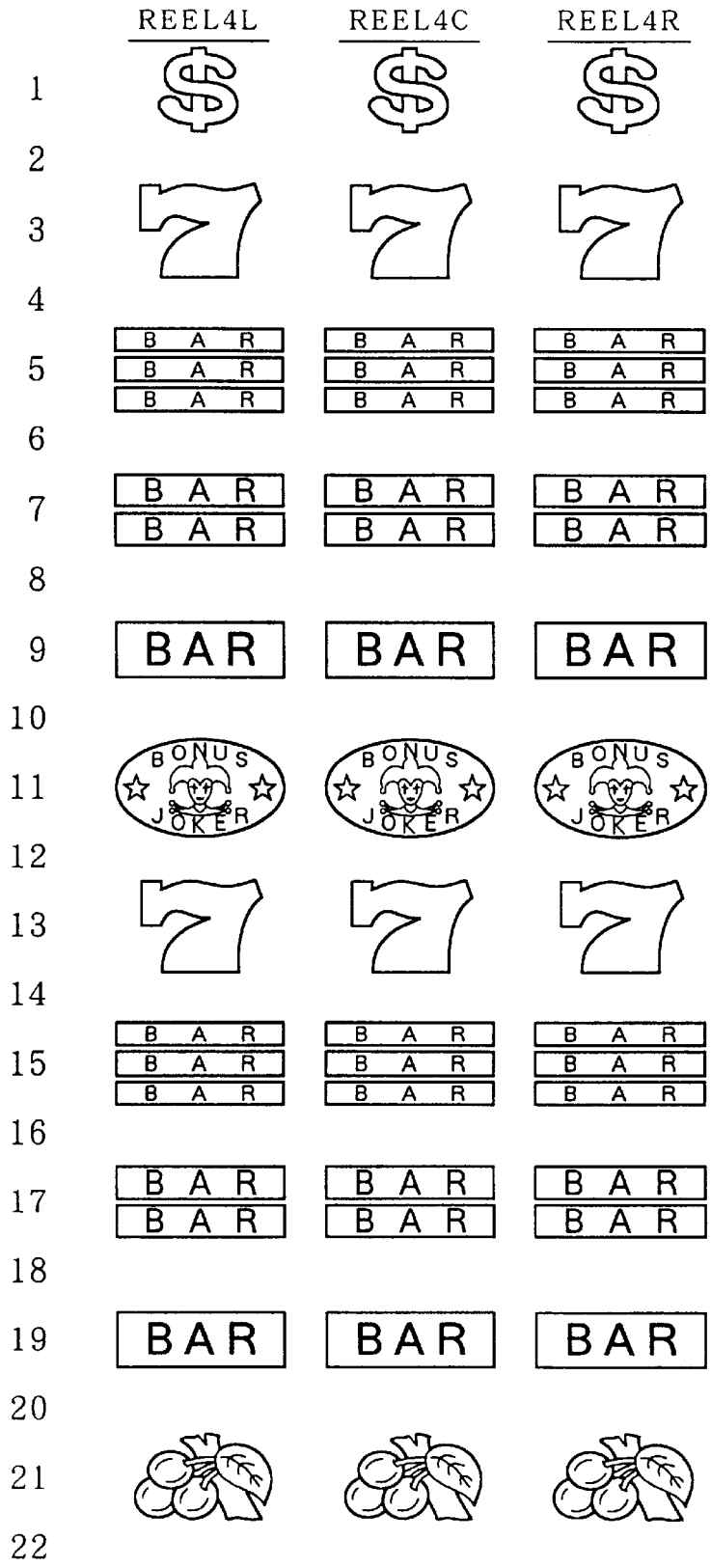
FIG. 2 is an example representation of the symbol arrangements positioned on the circumferential periphery plane of the rotation reel consisting the variable display device.

On a front face of a cabinet 2 that forms the housing (not specifically designated) of slot machine 1, three display windows 3L, 3C, and 3R are horizontally arranged side-by-side, and various kinds of symbols (not shown in this figure) are displayed in alignment with a central winning line 14. Further ones of the various kinds of symbols (not shown in this figure) are displayed in upper and lower positions of each display window (see, FIGS. 8 to 10). As shown in FIG. 2, these symbols are displayed on the surfaces of sheets that are applied to the circumferential surfaces of three rotation reels 4L, 4C, and 4R. The three rotation reels are arranged inside of cabinet 2 so as to be viewable in display windows 3L, 3C, and 3R.

In the embodiment shown in FIG. 2, there are shown to be twenty-two (22) positions on the surfaces of each sheet, along their respective lengthwise directions. The symbol "$" is a "Trigger symbol" (described hereinafter) and the symbol "7," which in this embodiment is the winning symbol, as well as other symbols are arranged at each odd-numbered position and "blanks" (fill out) are arranged at each of the even-numbered positions.

The rotation reels, with the sheets disposed on their respective circumferential surfaces, constitute a moving display. The moving display shown and discussed herein is but an example of a variable display that can be employed as the variable display device or unit of the present invention. In an alternative embodiment, an electric variable secondary display that displays a variety of the symbols and images, such as on the display screen of a CRT or a liquid crystal display, can be used as the variable display.

A start lever 5 is disposed on a lateral side of cabinet 2 and initiates rotation of the reels in response to operation by the player. The start lever is pivotally movable by the player within a predetermined angular range.

A liquid crystal display device 6 is used in one embodiment of the invention as a secondary display. Liquid crystal display device 6 is centrally disposed below the display windows on the front surface of cabinet 2. The liquid crystal display device displays a display screen 6*a* (not shown in this figure) having 9 blocks formed by vertical lines and horizontal lines (see, FIG. 7.). When display windows 3L, 3C, and 3R, which are disposed above liquid crystal display 6, are viewed from the front face, each block is arranged so as to display the symbol images identical to the symbols for the secondary game (trigger symbol or other specific symbols) that are displayed at the time when each reel 4L, 4C, and 4R is stopped.

Below liquid crystal display device 6, a coin inlet 7 where coins (or medals) of game media are inserted, a spin switch 8 is provided for starting the reels by operation of a push button, as an alternative to the actuation of the above described start lever 5. A 1-BET switch 9 is provided for betting only one coin credited on a game, allowing a one-time button-pushing operation. A maximum BET switch 10 is provided for betting maximum numbers of coins that can be bet on one game. Additionally, there is provided a C/P switch 11 for changing credit/payout of coins acquired by the player as a result of the button-pushing operations. Beneath the front face of cabinet 2, there is disposed a coin tray 13 for saving coins paid out via a coin outlet 12 in response to the actuation of C/P switch 11.

Figure 3:
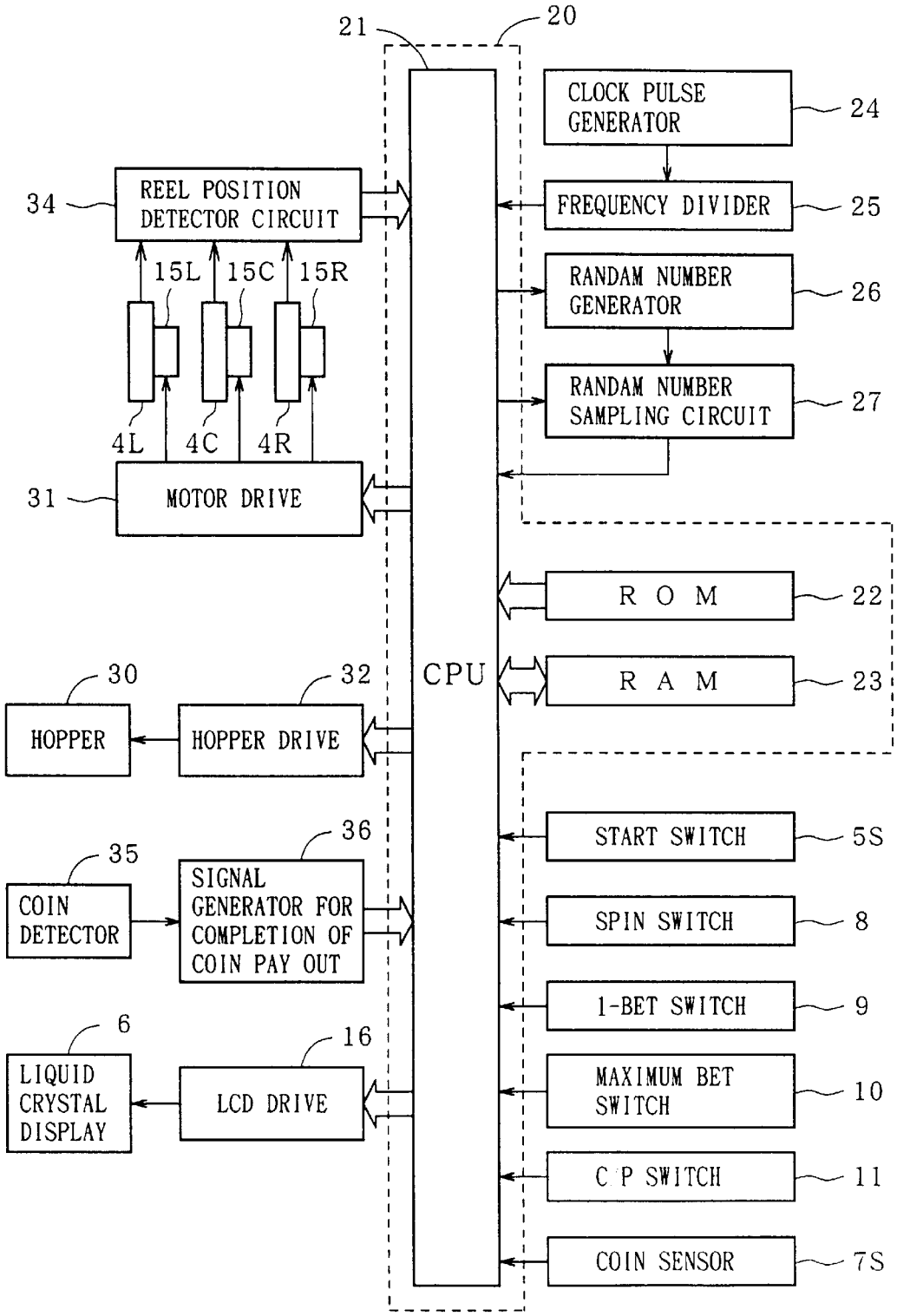
FIG. 3 is a block diagram of the circuit construction used for the slot machine.

FIG. 3 shows a simplified circuit construction that includes a controller portion for controlling the game procedure operation in the slot machine, and peripheral equipment (such as motors and an associated driver) electrically connected thereto.

In this case, the controller is formed of a microcomputer 20 (delineated by a dashed line in the figure) as a principal element, and a circuit for random number sampling coupled thereto. Microcomputer 20 includes a CPU 21 that executes control operations according to a preset program, and a ROM 22 and a RAM 23, as memories. CPU 21 has connected thereto a clock pulse generator circuit 24 for generating a reference clock pulse, a frequency divider 25, a random number generator 26 for generating random numbers to be sampled, and a random number sampling circuit 27. Random number sampling may be executed in microcomputer 20, i.e. in an operation program of CPU 21. In such an embodiment of the invention, a random number generator 26 and a random number sampling circuit 27 may be omitted, or they may be provided as a back up to the random number sampling operation.

In ROM 22 of microcomputer 20, in addition to the game control of a slot machine, there are stored the information and data necessary for executing procedures that would cause liquid crystal display 6 to indicate a plurality of display images, in a manner that will be described hereinbelow.

In the circuit of FIG. 3, the main actuators include stepping motors 15L, 15C, and 15R for driving respective ones of reels 4L, 4C, and 4R mentioned above into rotation, a hopper 30 (a driver for pay out is included) that accommodates coins of game media, and the above-mentioned display screen. They are connected to the outputs of CPU 21 via a motor drive circuit 31, a hopper drive circuit 32, and a LCD drive circuit 16, respectively. These drive circuits receive control signals such as driving commands or the like outputted from CPU 21, and control the operations of respective actuators.

Arrangements for generating input signals that are necessary for microcomputer 20 to generate control signals are connected to the inputs of CPU 21. These include, for example, a coin sensor 7S for detecting coins inserted into medal inlet 7, a start switch 5S for detecting operations of start lever 5, spin switch 8, 1-BET switch 9, maximum BET switch 10, C/P switch 11, a reel position detector circuit 34 that receives pulse signals from reel rotation detectors of the variable display unit and supplies signals to CPU 21 for detecting the position of each reel, and a coin payout completion signal generator circuit 36 that supplies a signal to CPU 21 for detecting completion of coin payout when the counted value of a coin detector 35 for detecting coins paid out from a hopper 30 reached the predetermined number.

Random number generator 26 generates random numbers in a predetermined range of numerical values, and a sampling circuit 27 samples one random number at predetermined times after start lever 5 has been operated. The random number thus sampled is evaluated to determine whether it belongs to the predetermined winning area stored in the memory portion of ROM 22, and if it belongs to the winning area, a "winning request signal" is generated.

After reels 4L, 4C, and 4R have been driven into rotation, the number of driving pulses supplied to each of stepping motors 15L, 15C, and 15R are determined, and the counted value is written in a predetermined area within RAM 23. A reset pulse is delivered from reels 4L, 4C, and 4R during each rotation of each reel, and these pulses are delivered to CPU 21 via a reel position detector circuit 34. CPU 21 clears the counted value of the driving pulses stored in RAM 23 to "0" by a reset pulse delivered in this manner. Thus, the counted value corresponding to a rotation position in a range of one rotation with respect to each of reels, 4L, 4C, and 4R is stored in RAM 23.

Correlation of the rotational positions of reels 4L, 4C, and 4R to the symbols is effected by a "symbol table" (not shown) that is stored within ROM 22. In addition, a "winning symbol combination table" (not shown) is stored within ROM 22. In the winning symbol combination table, the symbol combinations to be winning, the numbers of coins of reward for winnings, and winning determination codes that represent the winnings are correlated to each other. The winning symbol combination table is accessed when control over reels 4L, 4C, and 4R is being executed and the winning confirmation is executed after all reels are stopped. A plurality of the display image data for executing the secondary game on the liquid crystal display device 6 and an image table for making it possible to indicate the images identical to the display symbols in relation to the display position of the symbols on reel 4L, 4C, 4R are stored in ROM 22.

Figure 4:
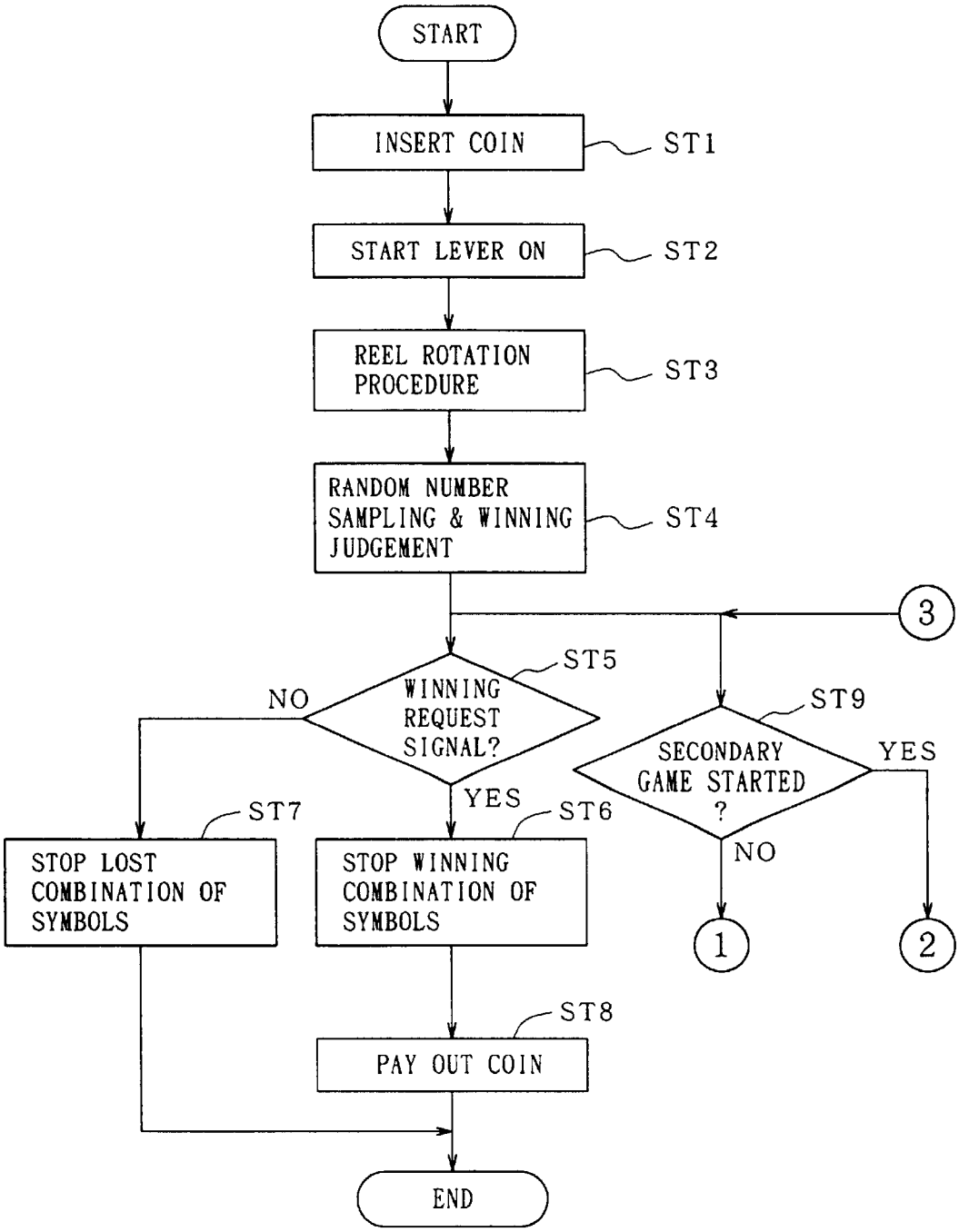
FIG. 4 is a flow chart showing a part of the control operation of the embodiment of the present invention.
Figure 5:
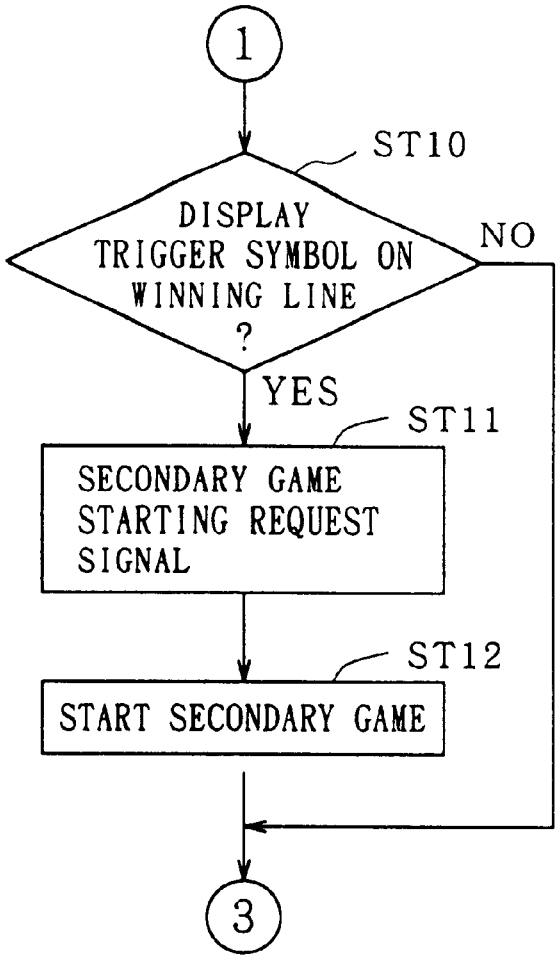
FIG. 5 is a flow chart subsequent to FIG. 4 showing the control operation when the secondary game has not started yet.
Figure 6:
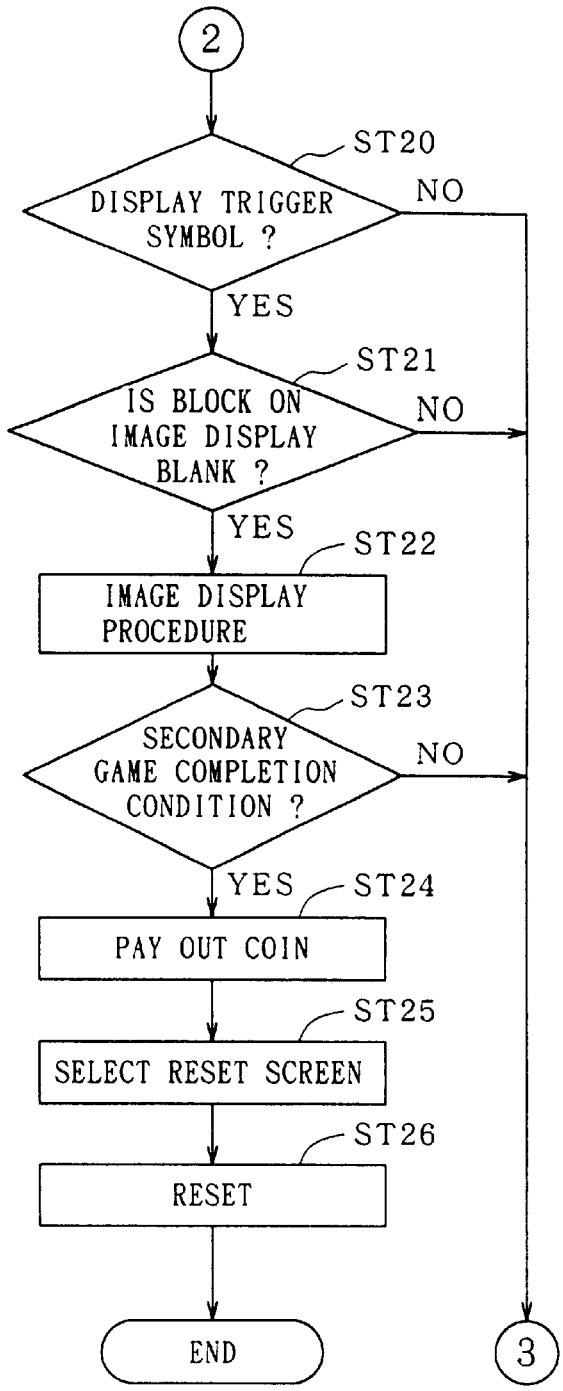
FIG. 6 is a flow chart subsequent to FIG. 4 showing the control operation when the secondary game has started.

FIGS. 4, 5, and 6 show flow charts of operating procedure steps for the principal game executed by rotation reels 4L, 4C, 4R (the first game) and the game alternatively performed by liquid crystal display device 6 (the secondary game). In the figures, ST1, ST2, . . . designate respective method steps.

The procedures are executed in CPU 21 within microcomputer 20 which is used as the game controlling system of slot machine 1. When the secondary display, such as liquid crystal display device 6, itself has a secondary CPU (not shown) for the display controlling portion, the secondary CPU may determine the display images in response to a display command (e.g., display commands corresponding to the kinds of the winning and unbinding) from CPU 21 for the game controlling means.

Referring to FIG. 4, when the power supply of the gaming machine (slot machine 1) is powered up and the player performs predetermined operations, such as by operating start lever 5 or spin switch 8 (ST2) after inserting coins into coin inlet 7 (step ST1), or operating 1-BET switch 9 or maximum BET switch 10, reels 4L, 4C, and 4R are caused to rotate, and the variable display is started (ST3). At this time, the winning or losing, and the corresponding stopping symbols, are determined in response to the random number (s) extracted at the random number sampling step (ST4). Thereafter, it is determined whether the "winning request signal" is generated (ST5). Depending on the result of this determination, the stopping control of rotating reels 4L, 4C, 4R is executed. That is, when the "winning request signal" is generated, the stopping control is executed so as to indicate a winning combination of the symbols (ST6) and when the "winning request signal" is not generated, the stopping control is executed so as to indicate a "losing combination" of the symbols (ST7).

In the procedure mentioned above, the actuation of the variable display at step ST3 is effected by CPU 21 supplying driving signals to motor drive 31, and thereby driving stepping motors 15L, 15C, and 15R, and rotating reels 4L, 4C, and 4R. In addition, the winning determination of step ST4 is realized by a random number that is sampled from random number generator 26 at an appropriate timing and the value of a random number extracted is evaluated to determine the group to which it belongs, in the predetermined winning area. Then, if the number was determined to be a winning number, CPU 21 delivers signals for controlling to stop reels 4L, 4C, and 4R in the symbol display positions corresponding to the kind of win to motor drive 31. Control over stopping at step ST6 or step ST7 is thus realized. When a win is determined, CPU 21 supplies coin pay out command signals corresponding to the kind of winnings to a hopper drive circuit 32, and executes the pay out of predetermined numbers of coins from hopper 30 (ST8). At that time, a coin detector 35 counts the number of coins paid out from hopper 30, and when the counted value reaches the predetermined number, the coin payout completion signal generator circuit 36 generates coin payout completion signals that are inputted to CPU 21. CPU 21 stops the drive of hopper 30 via hopper drive 32, and thereby the procedure of paying out coins is completed.

In addition, CPU 21 executes the determination of starting the secondary game on the liquid crystal display device 6 as well as the determination of the win (ST9). The secondary game is started when the predetermined specific symbols such as "trigger symbol," for example "$," are displayed on winning line 14 indicated in the center of display windows 3L, 3C, 3R. Therefore, when the "trigger symbol" is displayed on wining line 14, it is determined that the secondary game has already been started.

When the determination in step ST9 indicates that the secondary game is not started, CPU 21 determines whether the display of the "trigger symbol" should be stopped on winning line 14 in the center of display windows 3L, 3C, 3R as shown in FIG. 5. This determination is executed depending on the stopping symbol determined from the determination of the winning of step ST4. If the result of the determination is "NO," the subroutine is returned to the determination of step ST9. Therefore, the secondary game is not started until the display of the "trigger symbol" is stopped on winning line 14 as described below.

On the other hand, if the determination has been made to stop the "trigger symbol" on winning line 14 in step ST10, a "secondary game starting request signal" is generated (ST11), and the trigger symbol (e.g., "$") is stopped on winning line 14 of any other of display windows 3L, 3C, 3R while displaying the symbol image identical to the trigger symbol (or it may be possible to display other specified symbols) in the block position corresponding to the display position of the trigger symbol on display screen 6*a* of liquid crystal display device 6, thereby the condition of liquid crystal display device 6 is brought into playing the secondary game (ST12). Thereafter, the subroutine is returned to the determination of step ST9.

If in step ST9 it is determined that the secondary game has been started, then it is determined whether or not the specific symbol (trigger symbol or other specified symbol) should be stopped on any of the center, upper and lower positions in display windows 3L, 3C, 3R (ST20) as shown in FIG. 6. When the result of the determination is "NO," the subroutine is returned to the determination of step ST9, described above.

On the other hand, if the determination has been made to display the specific symbols in display windows 3L, 3C, 3R in step ST20, a further determination is executed as to whether the block on display screen 6*a* of liquid crystal display device 6 will or will not display the symbol image therein (i.e., whether it is blank or not) (ST21). When the symbol image has already been displayed (i.e., not blank) the subroutine is returned to the above-mentioned step ST9. However, the corresponding block still remains as a blank, and the symbol image is displayed in the corresponding block when the specific symbols are displayed in display windows 3L, 3C, 3R (ST22), Then the subroutine determines whether the condition for the completion of the secondary game (ST23) is realized or not. The condition for the completion of the secondary game may be adopted from any one or all of the following conditions:

1. all of the 9 blocks of display screen 6*a* are occupied by the symbol image (the condition for perfection of the secondary game screen);
2. the specific symbol images are displayed in the specific blocks of the 9 blocks;
3. The specific symbol images are displayed in the three blocks lined in a row (laterally), or in a column (vertically), or along with diagonal directions within the 9 blocks. (When this condition is selected, the secondary game becomes similar to the bingo game.)

When the determination of the above-mentioned step ST23 is "YES," the coin payout signal is supplied to hopper drive circuit 32 to pay out a predetermined number of coins (ST24). Although the number of coins paid-out may be a certain fixed number, it may be possible to pay out different numbers of coins depending on the conditions 1 to 3 described above (for example, when the above condition 1 is realized, hundreds of coins are paid-out at most) so that the interest for the secondary game may be further enhanced.

If the determination of step ST23 is "NO", then the subroutine is returned to the determination of step ST9 shown in FIG. 4.

After pay out the coins, CPU 21 prepares the next game to be executed by resetting display window 6*a*. That is, CPU 21 executes "reset screen selection procedure" wherein the initial condition for display screen 6*a* is optionally selected from predetermined plural numbers of initial screens (reset screens) (ST25), and then executes "resetting procedure" to replace display screen 6*a* with the selected reset screen (ST26). The secondary game has been completed thereafter.

In the above reset screen selection procedure, it is determined which reset screen is selected from the predetermined reset screens depending on the value of the random number extracted by the random number sampling. Alternatively, it may be possible to dispose an alternative operation portion such that the above resetting procedure may be performed by manual operation by the player.

Figure 11:
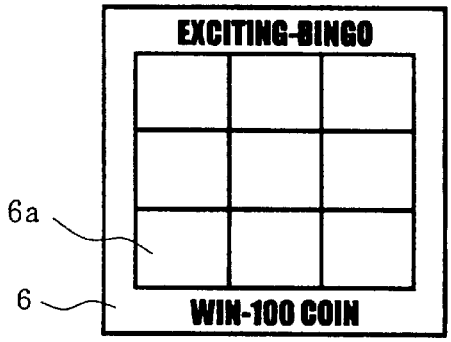
FIG. 11 is a representation that illustrates reset screen on the display screen of the liquid crystal display device.
Figure 11:
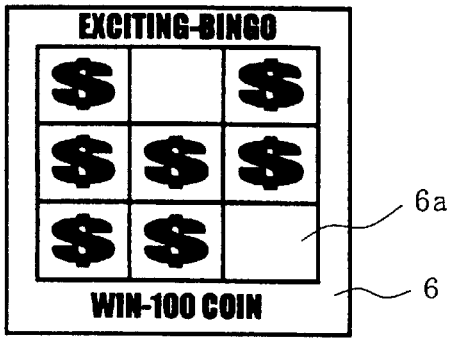
Figure 11:
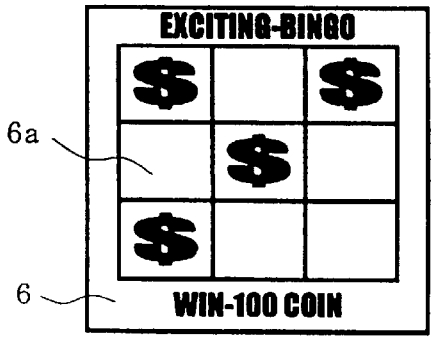
Figure 11:
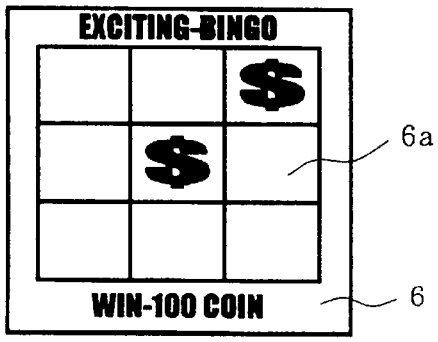

Plural kinds of screens are provided as the above mentioned reset screen, See, for example, FIG. 11, wherein illustrative examples of (A) all clear screen, (B) high condition screen, (C) medium condition screen, and (D) low condition screen, are illustrated. These reset screens are stored in ROM 22. In this embodiment, (A) all clear screen corresponds to the condition wherein no image is displayed in the blocks on display screen 6*a*. The (B) high condition screen corresponds to the condition that is near to the condition wherein the 9 blocks are all occupied and hence there is the great advantage to the player. The (C) medium condition screen corresponds to the condition that is far from the condition than the high condition till the 9 blocks are all occupied. The (D) low condition screen corresponds to the condition that is much further from the condition where the 9 blocks are all occupied. However, the low condition screen is more advantageous than the above all clear screen.

With the optional display of a variety of reset screens, the player expects the advantageous reset screen when the next game is started after the secondary game has been completed.

Next, the symbols displayed in display windows 3L, 3C, 3R as described above and the symbol images displayed in the blocks of the display screen 6*a* of liquid crystal display device 6 will be described.

Figure 7:
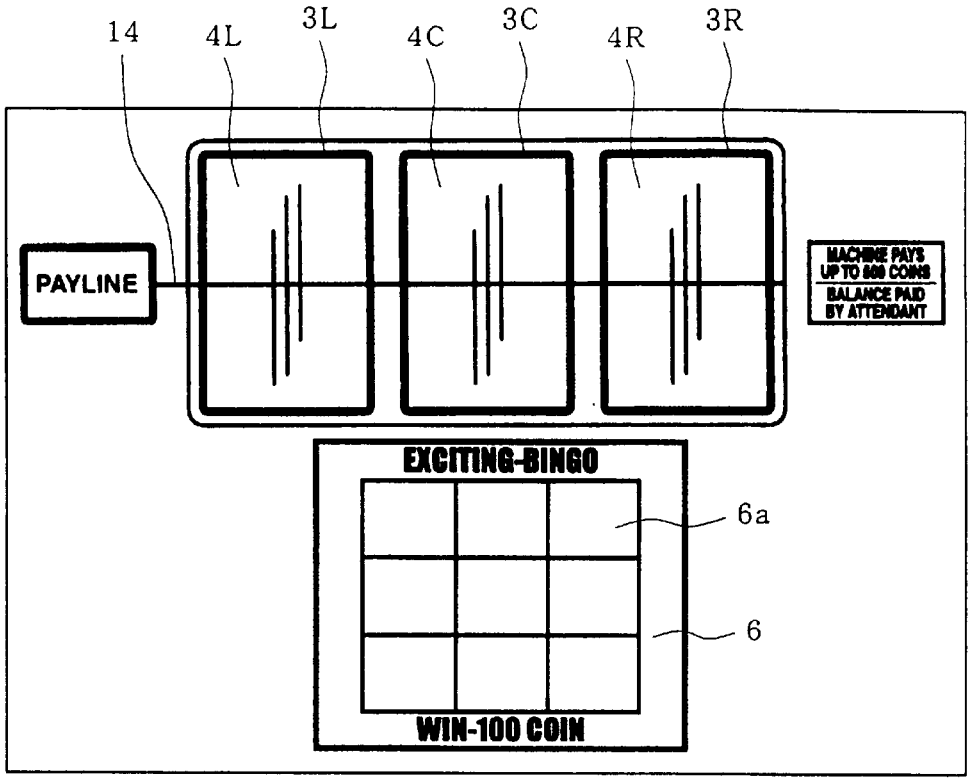
FIG. 7 is a representation that illustrates the display condition and the displayed symbol images on the liquid crystal display device after the variable display is started.

FIG. 7 shows the condition where reels 4L, 4C, 4R in the three display windows rotate and no symbol image is displayed in the blocks of display screen 6*a*.

Figure 8:
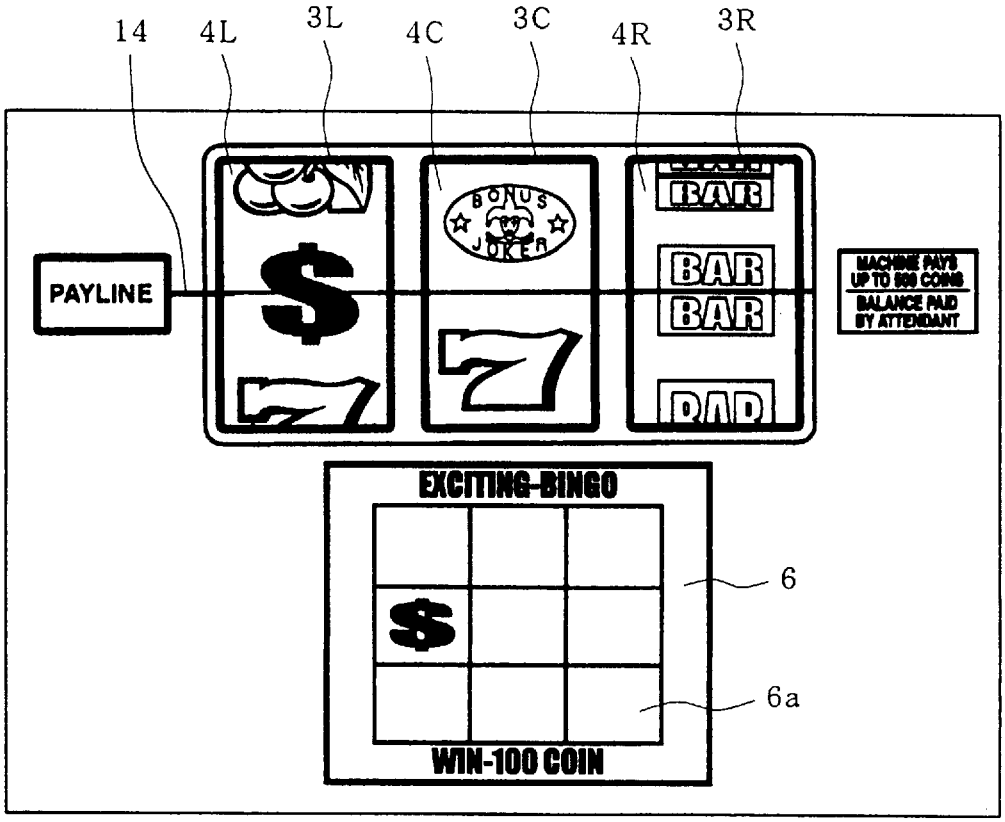
FIG. 8 is a representation that illustrates the display condition at the time when the variable display is stopped and also illustrates the displayed symbol images on the liquid crystal display device.

FIG. 8 shows the condition at the time when the three reels are stopped rotation thereof. At this time, it is assumed that a specific symbol "$" is selected as the trigger symbol. In FIG. 8, this specific symbol stops on winning line 14 in a left side window 3L so that the secondary game may be started as mentioned above and the symbol "$" is displayed in the left middle block of display screen 6*a*.

Figure 9:
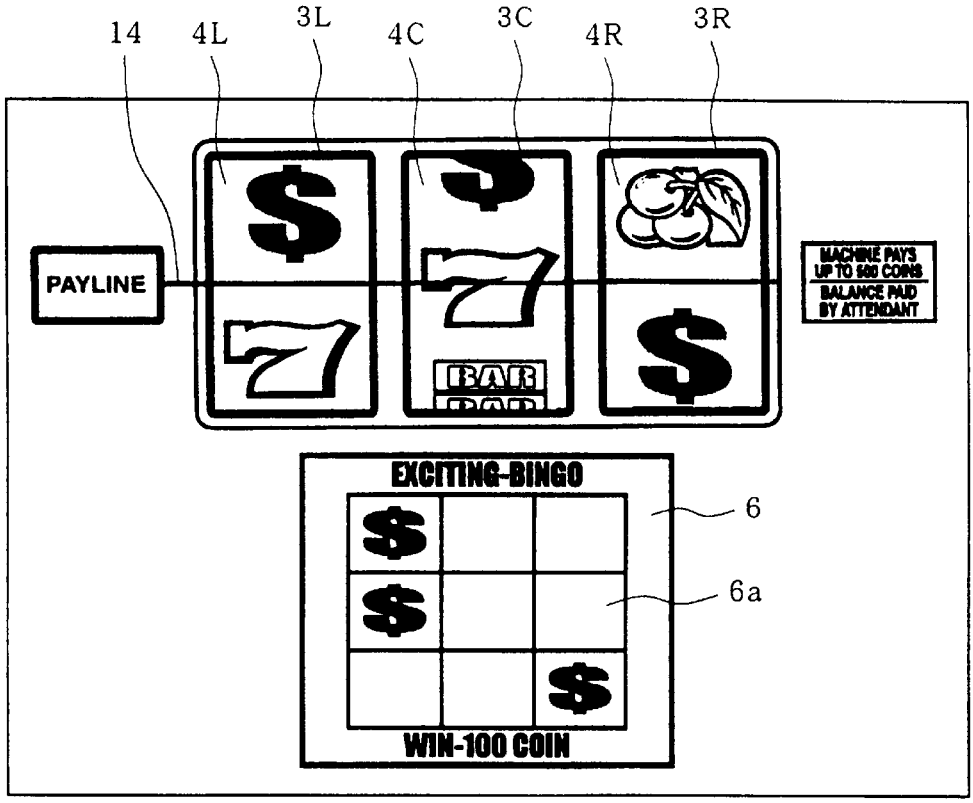
FIG. 9 is a representation that illustrates the display condition at the time when the variable display device is stopped after the secondary game is started and also illustrates the symbol image "$" being displayed on the display screen of the liquid crystal display device.

FIG. 9 shows the condition where the particular symbols "$" are displayed in left and right display windows 3L, 3R at the time when the three reels 4L, 4C, 4R are stopped. More specifically, the particular symbol "$" is stopped at the upper position in left display window 3L, and the other symbol "$" is stopped at the lower position in right display window 3R. At this time, display window 6*a* already displays "$" in its left middle block and the symbol image "$" is displayed in the blocks corresponding to the display positions of the specific symbols "$" in left and right display windows 3L, 3R.

Figure 10:
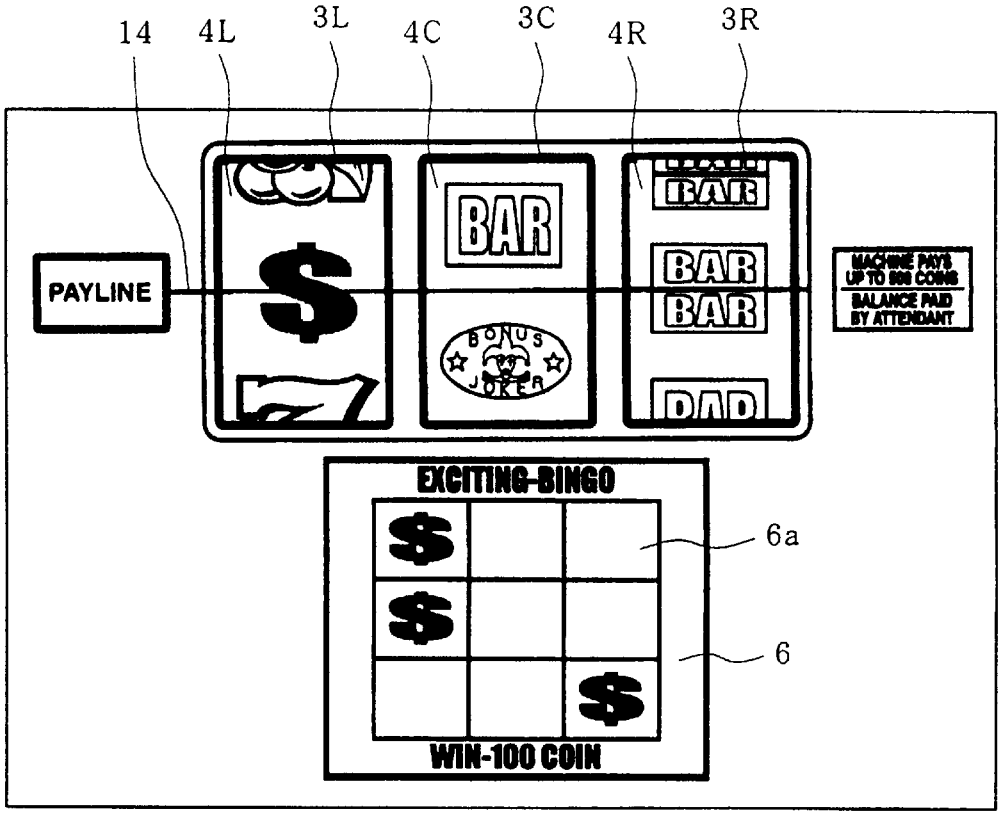
FIG. 10 is a representation that illustrates the display condition at the time when the variable display device is stopped after the secondary game is started and also illustrates the symbol image "$" being displayed on the other position to the position of FIG. 9 of the display screen of the liquid crystal display device.

FIG. 10 shows the condition when three reels 4L, 4C, 4R are stopped again after the display shown in FIG. 9 and "$" is displayed in the middle position of left side display window 3L. At this time, display screen 6*a* has already displayed "$" in the left middle block, and then the display thereof is not changed.

As described above, the symbol images "$" are displayed in the block corresponding to the display positions thereof in display screen 6*a* every time the specific symbol display "$" is stopped in display windows 3L, 3C, 3R. Particularly, in the display screen of FIG. 10, if the end condition of the secondary game is selected to the "bingo game," when the symbol image "$" is displayed in the center block, the "bingo game" goes out so that the gaming machine may pay out the certain number of the coins.

Figure 12:
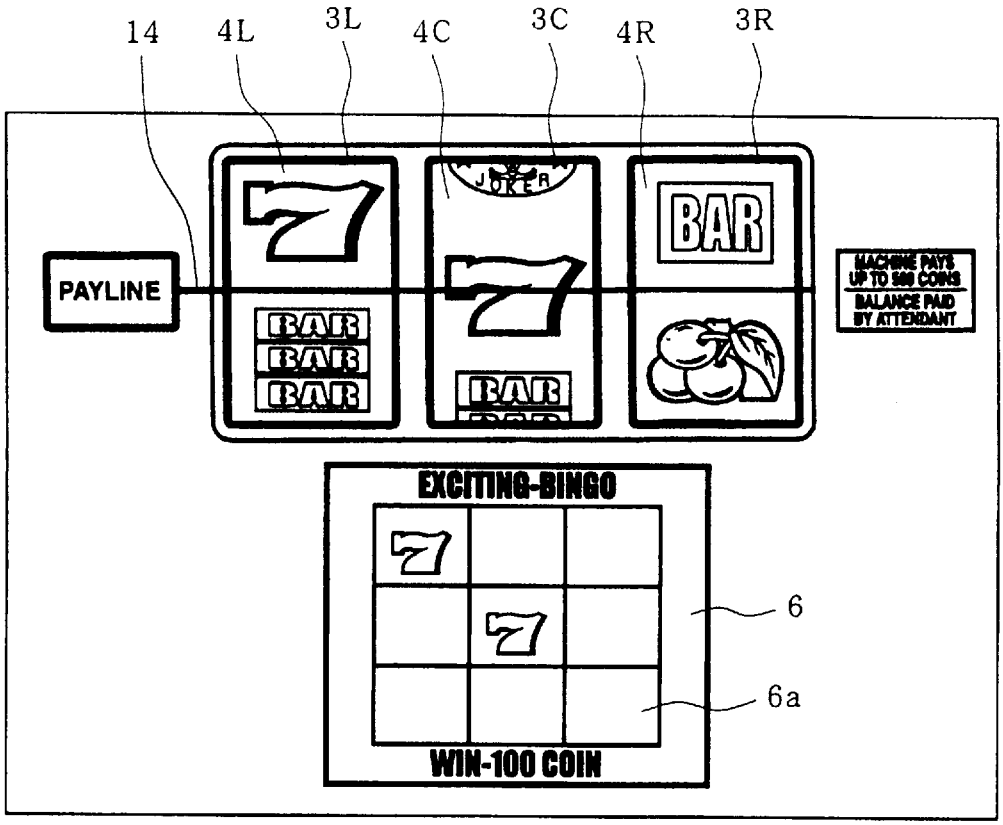
FIG. 12 is a representation that illustrates the display condition at the time when the variable display device is stopped after the secondary game is started and also illustrates the symbol image "7" being displayed on another position of the display screen of the liquid crystal display device.

In another embodiment of the invention, the symbol "7" which is used for performing the principal game as shown in FIG. 12 may alternatively be used for the secondary game without providing the particular symbol such as "$" for the symbol of the secondary game shown in FIGS. 8 to 10.

Alternatively, the secondary game may be performed using a plurality of the symbols without using only one kind of the symbol. For example, it may be possible to use four predetermined symbols such as "$" (PT1), "7" (PT2), "3BAR" (PT3), and "2BAR" (PT4) and the profit allotments may be changed depending on kinds of the symbols. That is, for example, the coin numbers paid-out when the blocks of the display screen 6*a* are occupied by the symbol images may be set to be 100 pieces when the symbols are "$" (PT1), to be 50 pieces when the symbols are "7" (PT2), to be 10 pieces when the symbols are "3BAR" and to be 5 pieces when the symbols are "2BAR," and the like.

Figure 14:
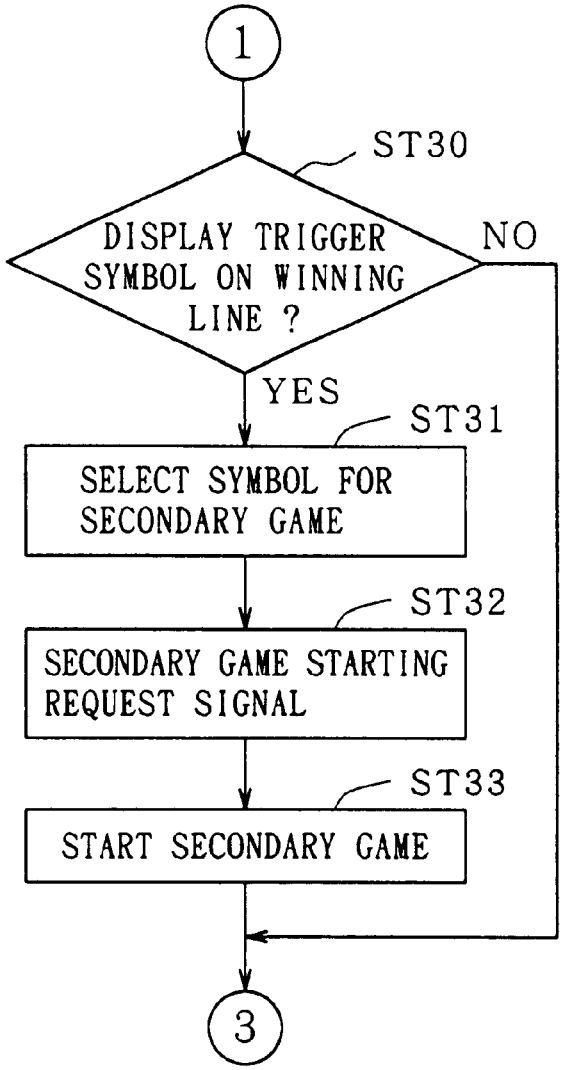
FIG. 14 is a flow chart subsequent to FIG. 4 under the case that the secondary game has not been started yet when plural numbers of the symbol images are used in the secondary game.
Figure 15:
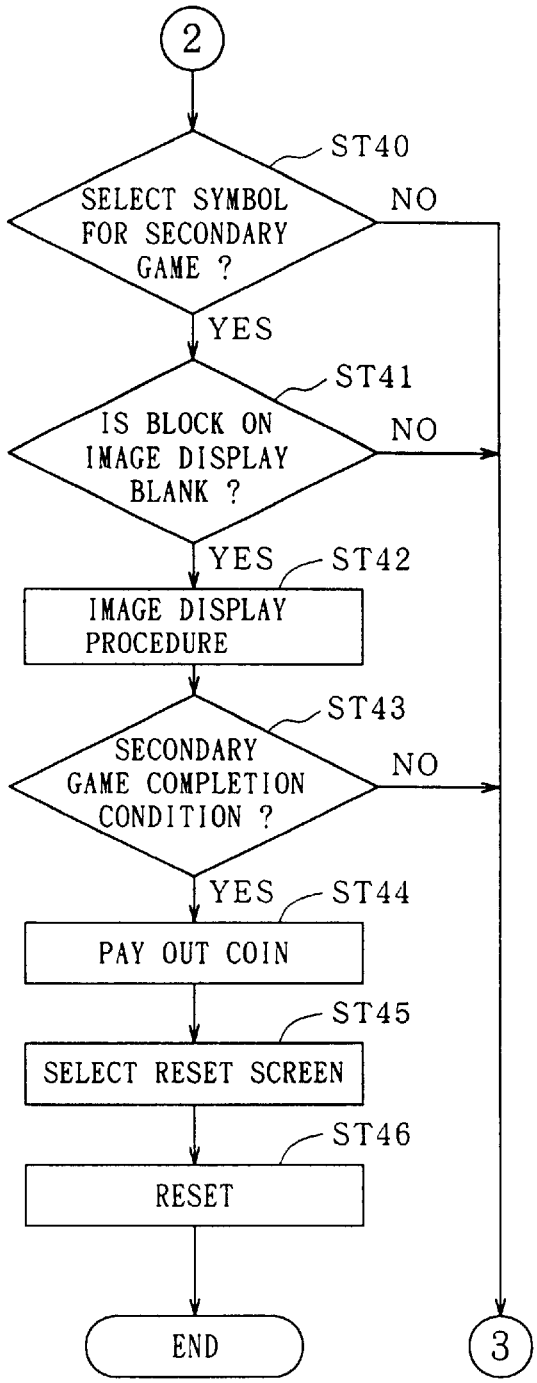
FIG. 15 is a flow chart subsequent to FIG. 4 under the case that the secondary game has been started when plural numbers of the symbol images are used in the secondary game.

FIGS. 14 and 15 show process steps when a plurality of the symbols is used. The procedure steps are executed as a partly different procedure from the procedures of FIGS. 5 and 6, after the determination whether the secondary game has been started or not in step ST9 of FIG. 3.

Figure 13:
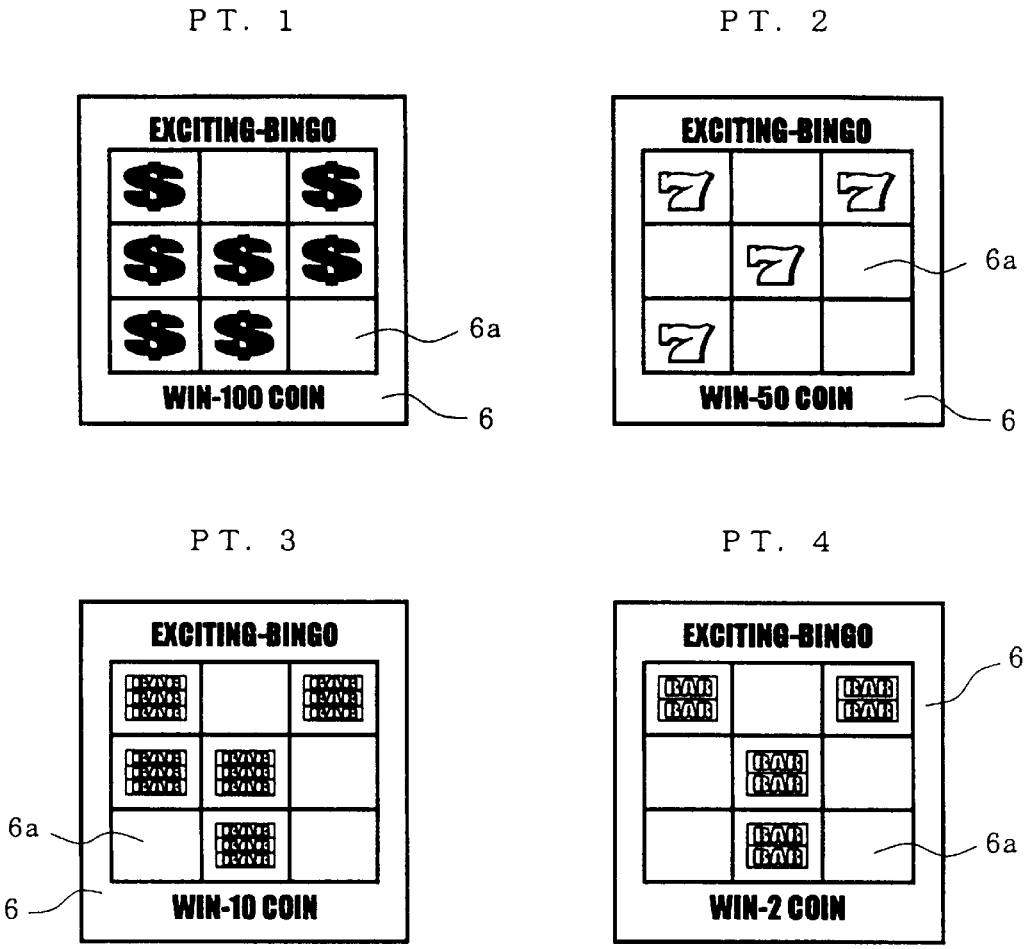
FIG. 13 is a representation of an illustrative display of the symbol images on the display screen of the liquid crystal display device when plural numbers of the symbol images are used in the secondary game.

In particular, when the determination is made in step ST9 that the secondary game has not been started, as shown in FIG. 14, first the determination is made whether a predetermined symbol (for example the symbol "$"), which is determined as the trigger symbols for starting the secondary game, is or is not to be displayed on winning line 14 in the middle of display windows 3L, 3C, 3R at step ST30. When the determination is "YES," the selection procedure of the symbols used for the secondary game is executed (ST31). Here, the symbols used in the secondary game are those predetermined to be used in the secondary game such as "$" (PT1), "7" (PT2), "3BAR" (PT3), and "2BAR" (PT4) as shown in FIG. 13, from which the symbols used are selected. After the determination of the symbols being used in the secondary game, "secondary game start request signal" is generated (ST32) and the display of the trigger symbol is stopped to display on line 14 of any one of the display windows 3L, 3C, 3R. Then, the symbol image identical to the trigger symbol is indicated in the block corresponding to the display position of the trigger symbol on the display screen 6*a* of liquid display device 6. Thereby, the condition may cause the secondary game to start on liquid crystal display device 6 (ST33). Then, the subroutine is returned to the determination of step ST9.

On the other hand, when the subroutine determines that the secondary game has already been started in step ST9, the subroutine further determines whether the symbols for the secondary game selected in the above step ST31 should be displayed in the display windows 3L, 3C, 3R. When the result of the determination is "NO," the subroutine is returned to the above step ST9.

When the subroutine determines that the symbols for the secondary game should be displayed in display windows 3L, 3C, 3R in step ST40, the subroutine further determines that the block that corresponds to the display position of the symbol to be stopped is not occupied by the symbol image (i.e., fill out) (ST41). When the symbol image has already been displayed (not fill out), the subroutine is returned to the determination of step ST9. However, when the corresponding block is not occupied with any symbol image, the symbol image is displayed in the block corresponding to the position thereof (ST42) after the symbol for the secondary game has been stopped to display in the display windows 3L, 3C, 3R.

Next, the subroutine determines whether the condition for the secondary game end condition is completed (ST43). The secondary game end condition is selected from the conditions 1 to 3, described above.

When the determination of step ST43 is "YES," the coin pay out command signal is supplied to the hopper drive circuit 32 to pay out the predetermined numbers of coins from hopper 30 (ST44). The number of coins paid-out here may be set to vary in response to the kinds of symbols selected for the secondary game, and the secondary game end condition.

When the determination in step ST43 is "NO," the subroutine is returned to the determination of step ST9 of FIG. 4.

After payout of the coins, CPU 21 prepares the next game to be executed by resetting display screen 6*a*. That is, CPU 21 executes "reset screen selection procedure" (ST45), where the reset screen is selected from the predetermined plural numbers of "reset screens," and executes "reset procedure" where display screen 6*a* is substituted with the selected reset screen (ST46), and then the game will be completed.

The reset screen is selected from any of the (A) all clear screen, (B) high condition screen, (C) medium condition screen, (D) low condition screen, and the like as above described FIG. 11 depending on the selected symbols for the secondary game.

In addition, when the several kinds of the symbols are used to execute the secondary game as described above, it is possible to execute the secondary game symbol select procedure (same as the procedure of step ST31 in FIG. 14) every one game prior to the procedure of step ST40 in FIG. 15. In this case, the player is interested in which kind of symbol image occupies much more in the block display portions of the display screen 6*a*, and therefore, the player pays his attention till the end of the secondary game.

When the several kinds of the symbols are used to execute the secondary game as described above, it may be determined to perform the secondary games using a plurality of symbol images (trigger symbol) sequentially by disposing a plurality of display screens (for example, block display portions PT1 to PT4 for each of four different symbols in FIG. 13). In this case, it is not necessary to make the secondary game able to start after the trigger symbol is stopped on the winning line, and the block is occupied anyway when the specified symbol is displayed. In this manner, it is clear for a person who does not perform the game to recognize how much of a win is expected.

Figure 16:
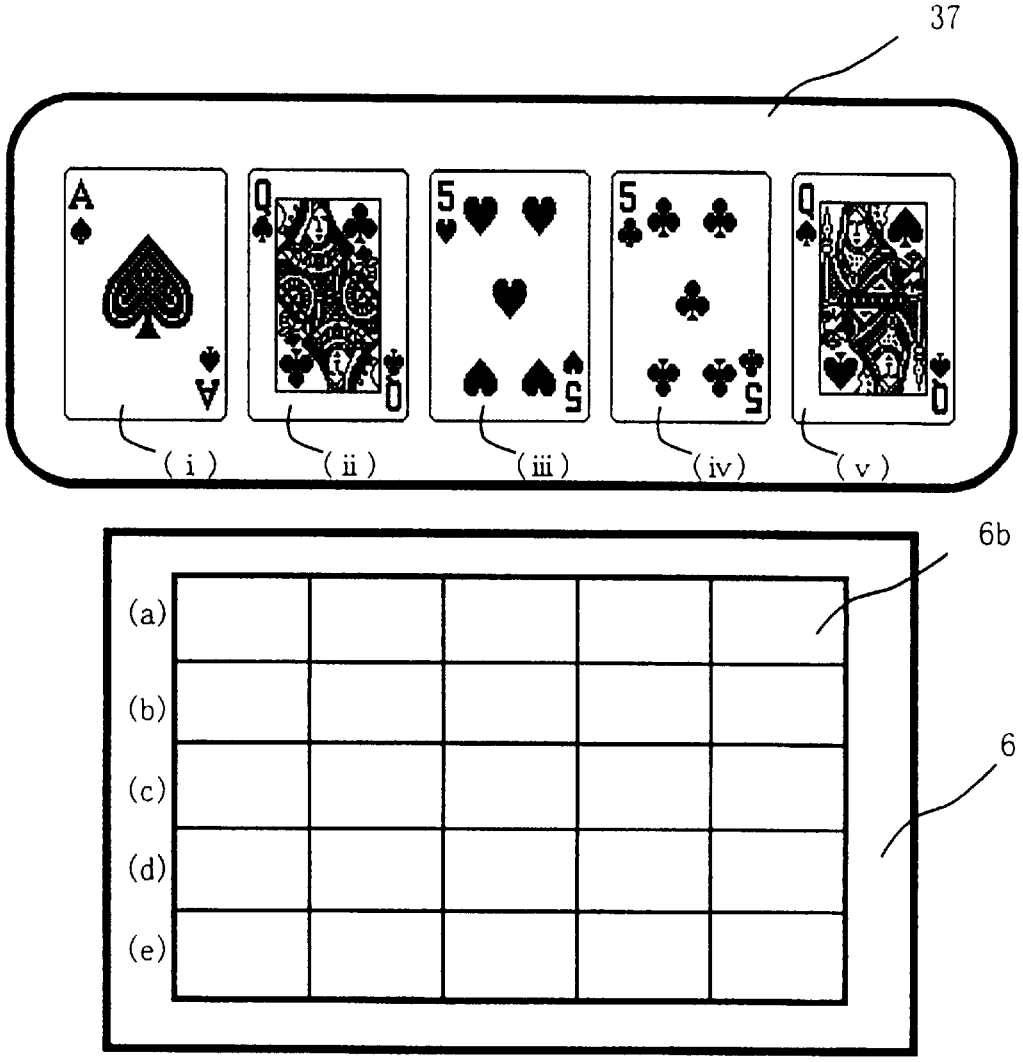
FIG. 16 is a representation of other embodiment that illustrates the variable display device and the liquid crystal display device thereof
Figure 17:
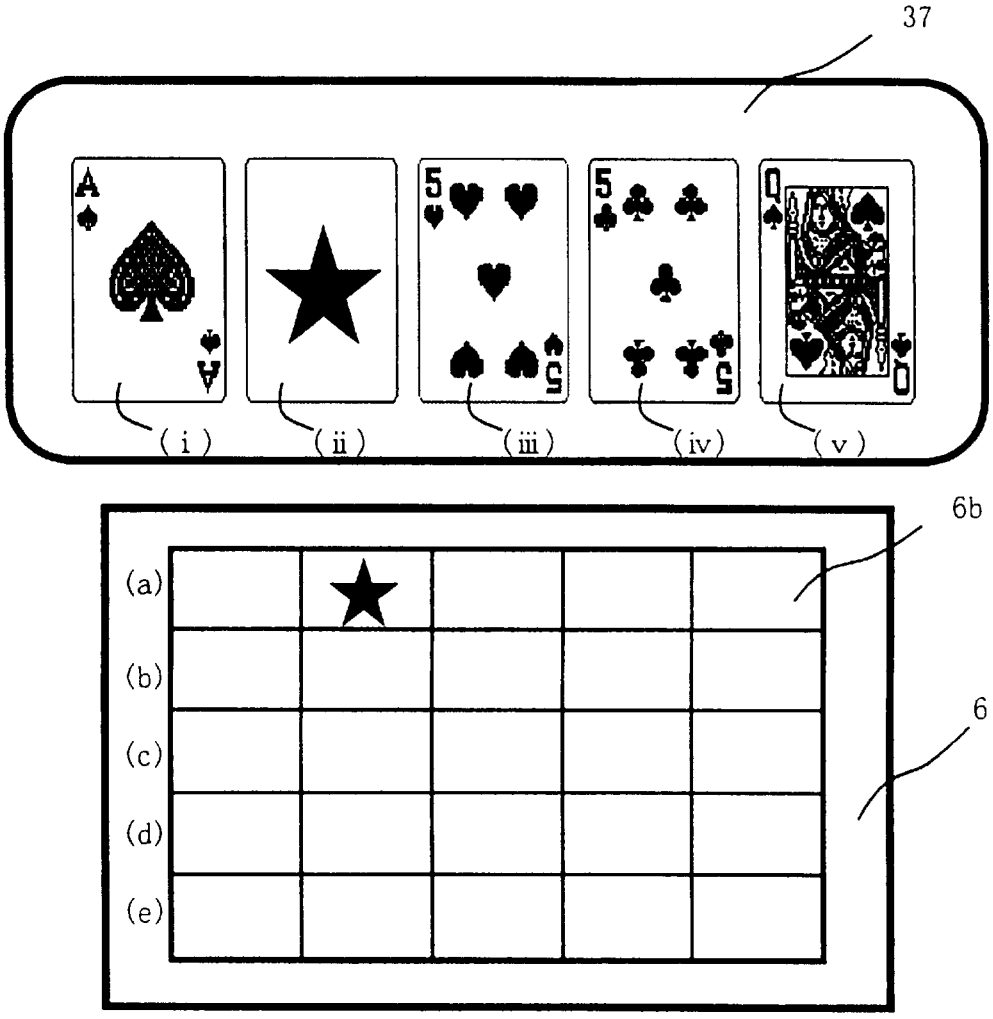
FIG. 17 is a representation that illustrates the display condition at the time when the variable display device is stopped after the secondary game is started in the video poker and also illustrates the symbol image "star" being displayed on the display screen of the liquid crystal display device.
Figure 18:
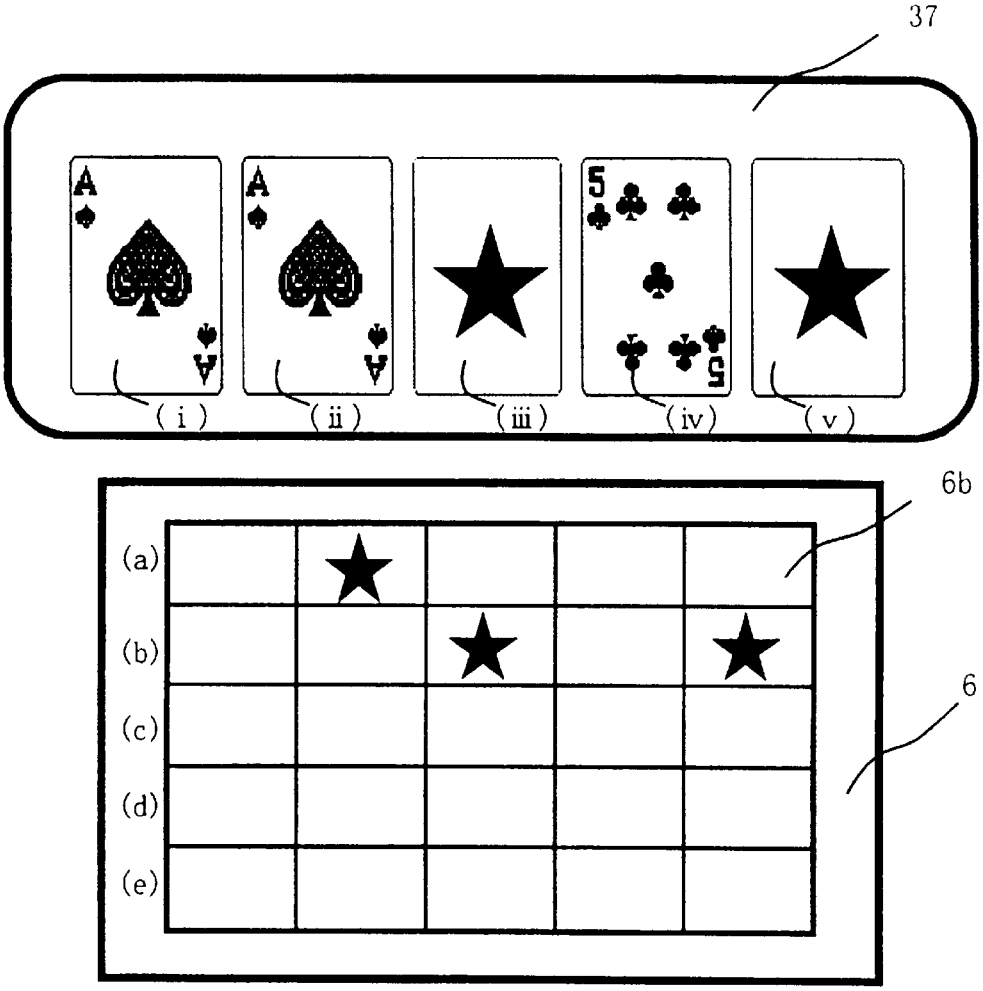
FIG. 18 is a representation that illustrates the display condition at the time when the variable display device is stopped after the secondary game is started in the video poker and also illustrates the symbol image "star" being displayed on the other position to the position of FIG. 17 of the display screen of the liquid crystal display device.

The above embodiment is described using the slot machine, however, the present invention will be applied to a video poker (a gaming machine) in which the poker game is performed on the variable display unit. FIGS. 16 to 18 show an example of the gaming display screen thereof.

FIG. 16 shows a video poker gaming machine that displays five kinds of game cards on five card display portions (i) to (v) that are disposed laterally and side-by-side on a video screen 37 of a variable display unit, such as liquid crystal display device 6 of the present invention. The liquid crystal display device is disposed below video screen 37 and indicates display screens 6*b* in which twenty-five blocks are formed by vertical and lateral lines. The display portion laterally aligned column comprising five blocks corresponding to the card display portions (i) to (v), and the display portions display the symbol images identical to the symbols for secondary game (trigger symbol or other specific symbols) depending on the display position of the game card that has the symbol for the secondary game. A plurality of laterally aligned groups each having the five blocks are arranged to form the display screen 6*b* from the blocks each consisting of five groups ((a) to (e)).

In FIG. 16, the game cards having the symbols for the secondary game are not displayed in the card display portion while displaying game cards for the ordinary poker game, and therefore, no symbol is displayed on display screen 6*b*.

In FIG. 17, the game card having the symbol for the secondary game (here, the symbol "star") is displayed in the card display portion (ii). On display screen 6*b*, the symbol image "star"identical to the symbol for the secondary game is displayed in the left second block viewed from the front face, correspondingly.

In the game thereafter, when the symbol for the secondary game is displayed again, the block that will display the corresponding symbol is shifted to the group (b) which lies one column below (2nd column). In FIG. 18, the card display portions (iii) and (v) are occupied by the game cards having the symbol "star" for the secondary game in (iii) and (v). The symbol images "star" are displayed in the left 3rd and 5th blocks of the group (b) of the 2nd column on display screen 6*b* viewed from the front face. Thereafter, the game comes to end by determining the win from the display condition of display screen 6*b* when the symbol image "star" is displayed in the group of $5^{th}$ column (e), or the secondary game may thereafter again be performed from the group of the 1st column (a) while keeping the displayed images on the display screen 6*b*.

In the former case, if the end condition of the secondary game is selected to the "bingo game," the game goes out of when the five symbol images are aligned along to any of the vertical direction, or the lateral direction, the diagonal direction and the gaming machine will pay out the predetermined number of the coins and then the resetting procedure will be executed as the above-mentioned slot machine.

In the latter case, when the game card having the symbol "star" is again displayed in the block on the card display portion in which the symbol image "star" has already been displayed, the display in the block is kept unchanged and the winning is given upon occupied all of the blocks, and then the game has been completed to execute the resetting procedure. Alternatively, the symbol for the ordinary poker game (such as a spade card, or the like) may be used as the symbol for the secondary game.

As described hereinabove, the display condition of the variable display when it is stopped is always reflected to the secondary game performed by the other display screen which is disposed in addition to the variable display for the principal game so that the interest for the entire game may be enhanced and the secondary game on the display screen may be possible to proceed together with a historic display while displaying for the symbols displayed past. Therefore, it is possible to know whether the completion of the game is near or not. In addition, it is easy for the player to know at a glance which display of the symbol of the game is needed for completion so that the player may continue the game with high expectation and tension, which are necessary to maintain player interest in the game.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A gaming machine comprising:

a variable display device provided with a winning line for variably displaying to a player a plurality of symbols necessary for a principal game;

a controller for controlling variable action of the variable display device; and a plurality of secondary display screens for displaying plural kinds of images necessary for a secondary game, each kind of image being associated with a symbol selected from the plurality of symbols, each of said secondary display screens having a plurality of blocks, wherein each secondary display screen is associated with a selected one of the plural kinds of images, each of which is further associated with a respective award, the secondary game being initiated when the controller detects a trigger symbol on the winning line when the variable action of the variable display is stopped, then one kind of image from among the plural kinds of images is selected to be displayed, and subsequently the selected kind of image is displayed corresponding in position to the symbol displayed in the variable display device in the plurality of blocks of the secondary display screen associated with said image in response to the displaying of the symbol with which the image is associated when the variable action of the variable display is stopped, and when at least one of the secondary display screens satisfies a predetermined end condition to complete the secondary game, the award associated with the image is given to the player.

2. The gaming machine of claim 1, wherein the award is further associated with the predetermined end condition.

3. A gaming machine comprising:

a variable display device provided with a winning line having a plurality of display portions for variably displaying a plurality of symbols necessary for a principal game, the plurality of display portions being disposed side-by-side in a line;

a controller for controlling a variable action of the variable display device; and a plurality of secondary display screens for displaying several kinds of images necessary for a secondary game, each kind of image being associated with a symbol selected from the plurality of symbols, each of said secondary display screens having a plurality of blocks arranged side-by-side in a line so as to form a group corresponding to respective ones of the plurality of display portions and having a plurality of such groups arranged vertically;

wherein each secondary display screen is associated with a respective one of the plural kinds of images, the secondary game being initiated when the controller detects a trigger symbol on the winning line when the variable action of the variable display is stopped, then the controller selects one kind of image to be displayed among the plural kinds of images and subsequently the selected kind of image is displayed in the block corresponding to a position of the plurality of display portions where the symbol associated to the image is displayed when the variable action of the payable display is stopped, and the secondary game being completed when any of the display screens satisfies a predetermined end condition.

4. A gaming machine comprising:

a variable display device having a plurality of display portions for variably displaying a plurality of symbols necessary for a principal game;

a controller for controlling a variable action of the variable display device; and a plurality of secondary display screens for displaying several kinds of images predetermined for a secondary game, each kind of image being associated with a symbol selected from the plurality of symbols, each of the secondary display screens having a plurality of blocks for displaying images;

wherein each secondary display screen is associated with a kind of image, the image to be displayed being determined in accordance with an image selection procedure in each play of the principal game in response to the detection of a trigger symbol displayed on the variable display device, and said image being displayed corresponding in position to said symbol in the plurality of blocks of the secondary display screen associated with said image, the secondary game being completed when any of the display screens satisfies a predetermined end condition.

* * * * *